United States Patent [19]

Leukel et al.

[11] Patent Number: 4,910,935

[45] Date of Patent: Mar. 27, 1990

[54] TWO-LAYER CAVITY FLOOR COVERING

[75] Inventors: Dieter Leukel, Duesseldorf; Andreas Bettgens, Duisburg; Horst Mueller, Duesseldorf; Horst Tamm, Haan, all of Fed. Rep. of Germany

[73] Assignee: Henkel Kommanditgesellschaft auf Aktien, Duesseldorf, Fed. Rep. of Germany

[21] Appl. No.: 216,936

[22] Filed: Jul. 8, 1988

[30] Foreign Application Priority Data

Jul. 9, 1987 [DE] Fed. Rep. of Germany ..... 3722831

[51] Int. Cl.[4] ..... E04F 15/20

[52] U.S. Cl. ..... 52/302; 52/323

[58] Field of Search ..... 52/309.4, 309.14, 612, 52/144, 145, 220, 221, 302, 323; 428/317.9, 160

[56] References Cited

U.S. PATENT DOCUMENTS

| | | | |
|---|---|---|---|
| 2,797,201 | 6/1957 | Veatch et al. | 52/309.4 |
| 3,334,458 | 8/1967 | Leemhuis | 52/220 |
| 3,501,878 | 3/1970 | Segal | 52/144 |
| 3,834,487 | 9/1974 | Hale | 52/144 |
| 4,206,267 | 1/1980 | Jungbluth | 52/309.14 |
| 4,663,909 | 12/1987 | Ogino et al. | 52/302 |

FOREIGN PATENT DOCUMENTS

| | | | |
|---|---|---|---|
| 0133556 | 2/1985 | European Pat. Off. . | |
| 0156247 | 10/1985 | European Pat. Off. . | |
| 976307 | 6/1963 | Fed. Rep. of Germany . | |
| 1683255 | 7/1970 | Fed. Rep. of Germany . | |
| 1779986 | 2/1973 | Fed. Rep. of Germany . | |
| 3201085 | 12/1980 | Fed. Rep. of Germany . | |
| 8024008 | 12/1980 | Fed. Rep. of Germany . | |
| 3444992 | 5/1986 | Fed. Rep. of Germany . | |
| 3505458 | 8/1986 | Fed. Rep. of Germany . | |
| 3510473 | 10/1986 | Fed. Rep. of Germany . | |
| 8800710 | 4/1988 | Fed. Rep. of Germany . | |
| 1349837 | 3/1963 | France . | |
| 1444105 | 7/1976 | United Kingdom | 428/317.9 |
| 2099722 | 12/1982 | United Kingdom | 428/317.9 |
| 2174733 | 11/1986 | United Kingdom | 52/220 |

*Primary Examiner*—James L. Ridgill, Jr.

*Attorney, Agent, or Firm*—Ernest G. Szoke; Wayne C. Jaeschke; Real J. Grandmaison

[57] ABSTRACT

A two-layer cavity floor construction comprising a base layer of profile element panels with a plurality of passage-forming spacer elements and a surface layer which combine to provide a minimal overall height with particularly good noise and footstep insulation. The base layer is formed from a noise-insulating material preferably based on polyurethane bound in a polyurethane foam.

20 Claims, 3 Drawing Sheets

FIG. 4
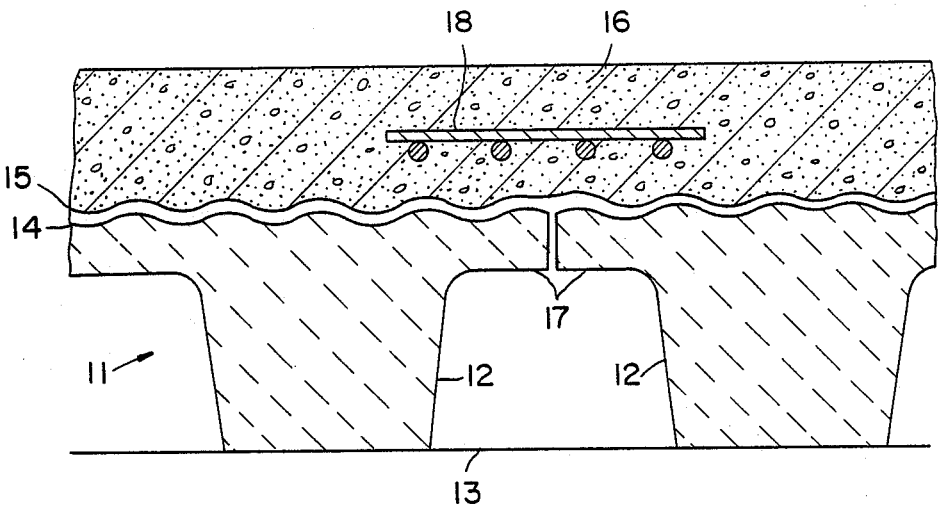
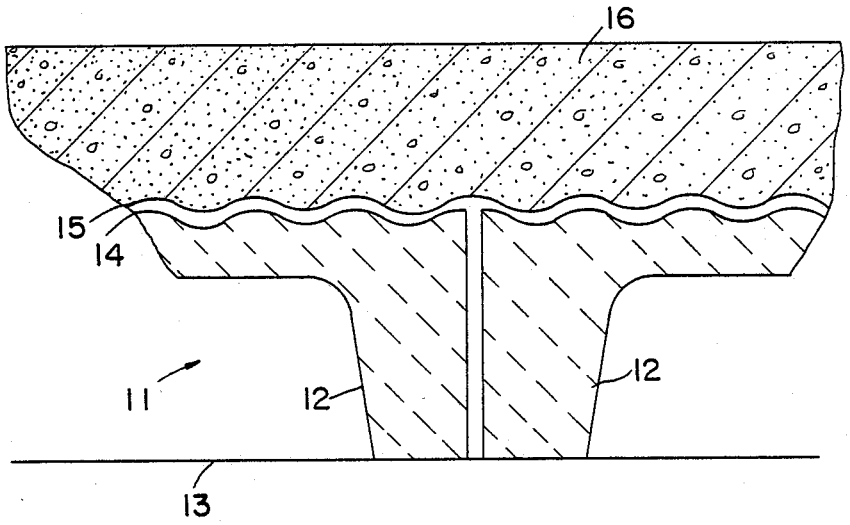
FIG. 5

TWO-LAYER CAVITY FLOOR COVERING

BACKGROUND OF THE INVENTION

1. Field of the Invention:

The invention relates to a two-layer cavity floor covering comprising a base layer having spacer elements, a cover layer and a rim binding for attachment to a wall surface.

Recent floor constructions which make it possible to install supply lines such a electrical cables, telecommunications, electronic data processing networks, ventilation, cooling and also heating systems under the actual floor surface have become prevalent to an ever greater extent in office buildings and the like. Such floor constructions are generally designated as cavity or double floor constructions. The advantage of these floor constructions compared with conventional floors lies in that, particularly in the case of subsequently required modifications, such as regrouping of working spaces in large office areas or in the case of supply line defects, a direct access to the supply lines in the floor system is possible where required without great effort or cost.

2. Discussion of Related Art:

It is known for this purpose to use two-part floor constructions comprising a carrier layer and a cover layer, which are formed of spacer elements. In such case, industrially prefabricated carrier plate systems having useful floor coverings are installed in situ on individual telescopic stands fastened on the floor and serve as spacer elements. The installation of these individual telescopic stands is very expensive since each element must be fastened separately at the floor surface. The versatility of their fabrication is limited since not all the floor coverings can be prefabricated industrially. In addition, the sound and heat insulation properties of such a system are not satisfactory.

It is also known to install casing elements made of synthetic material or metal and to subsequently pour a liquid polish based on anhydrite onto these elements. The appreciable installation height of about 15 centimeters, which in most cases excludes a subsequent installation during a refurbishing operation, and the long drying time of the floor polish requiring about 28 days are disadvantageous in such a system.

Two-layer floor coverings are further known from German Utility Model 80/24 008 in the heating, ventilation and air-conditioning field. The carrier layer therein consists of individual spacer elements which must be fastened separately on a floor surface, and a cover layer of example of wood plates or the like is provided thereon particularly in the case of the refurbishing of old buildings. The assembly of the carrier layers, constructed as individual elements for the cover layer, is very expensive. Further, inadequate footstep sound reduction is provided by this floor covering.

A cavity floor construction of the type herein is known from Gemman patent application 32 01 085. In addition to a base layer and a surface layer, this known cavity floor construction comprises a sound-insulating layer of foam, fiber mats or the like arranged on the subfloor and also a pressure-distributing layer. Although this floor construction, which comprises a total of four layers, is distinguished by relatively good noise insulation, it is unsuitable in many cases, particularly for subsequent installation in a renovation program, on account of its considerable overall height.

Another version of a cavity floor construction of the type herein is known from German patent application 33 28 792. In this floor covering, the base layer is oppositely arranged, i.e. the spacer elements are directed towards the subfloor surface while the surface layer lies on the continuous surface of the base layer. The surface layer may consist of plastic screwed, wood, concrete or the like. It is possible in this way to level out any uneveness in the floor by forming the surface layer accordingly. However, the disadvantage of this cavity floor covering is that there is no insulation of noise or footstep sounds, which is particularly necessary in rooms accommodating sensitive electronic equipment.

Thus, an object of the present invention is to provide a two-layer cavity floor construction which combines minimal overall height with particularly good noise and footstep insulation.

Another object of this invention is the provision of a two-layer cavity floor covering which enables a simplified assembly and provides a substantial footstep sound reducing effect.

DESCRIPTION OF THE INVENTION

Other than in the operating examples, or where otherwise indicated, all numbers expressing quantities of ingredients or reaction conditions used herein are to be understood as modified in all instances by the term "about".

The afore-mentioned objects are attained in accordance with this invention by providing a two-layer cavity floor covering wherein the base layer comprises a profile element panel having a plurality of spacer elements which form channels therein, and a cover layer thereover. The cavity floor covering construction is of the type wherein the base layer is formed from a noise-insulating material containing polyurethane bound in a polyurethane foam.

A cavity floor covering constructed in this way is distinguished by particularly good noise and footstep insulation, so that it is particularly suitable for use in rooms where noise-sensitive equipment, such as electronic machinery, is accommodated. At the same time, the cavity floor construction is also distinguished by its particularly low overall height because no other noise insulating layers are necessary. The cavity floor construction according to the invention is thus suitable not only for installation in new buildings, but also and in particular for renovation programs where in most cases only limited installation space is available.

According to the invention, different noise-insulating materials may be used for the base layer according to the special in-use conditions. Thus, the noise-insulating material may consist of polyurethane and mineral aggregate or expanded clay bound in a polyurethane foam or of polyurethane and rubber bound in a polyurethane foam.

The noise-insulating material may also consist of polyurethane and an organic recycled material or a porous material bound in a polyurethane foam, the porous material preferably consisting of expanded clay.

In one preferred embodiment of the invention, the panel-like surface layer lying on the spacer elements of the profile element panels comprises sawdust, cement or an acrylate dispersion as a constituent. This embodiment is particularly suitable for level subfloors where no differences in height in the subfloor surface have to be corrected. In this case, the surface or cover layer formed in accordance with the invention, in combination with the prescribed profile element panels, leads to particularly high noise and footstep insulation.

Another particularly practical embodiment of the invention is distinguished by the fact that the surface layer lying on the profile element panels with spacer elements directed towards the surface of the subfloor is in the form of a quick-drying screed. This embodiment is particularly suitable for uneven subfloors because the uneven areas can be leveled out by the surface layer. The quick-drying screed requires a particularly short drying time of at most only two days, so that considerable time can be saved compared with normal floors where the secedes take about 30 days to dry. Particularly good noise and footstep insulation can be obtained by corresponding additives in the quick-drying scored in conjunction with the particular noise-insulating base layer.

To this end, the cavity floor construction according to the invention is characterized, for example, in that the quick-drying screed comprises alumina cement, gypsum and organic additives and also aggregates as constituents.

In a further embodiment, the invention provides that the rim binding is formed of rim elements which are straight-faced at the wall face and the lower edge of which rests on the floor, or the rim biding is formed of rim elements which are provided with a bearing shoulder for support at the upper edge of the cover layer and the lower edge of which provides a spacing from the floor of the floor covering. Both these different rim elements serve as terminating profiles for the cavity floor covering according to the invention. Depending upon the type of application of the floor covering, the use of the one or the other rim element is particularly suitable.

BRIEF DESCRIPTION OF THE DRAWINGS

The invention is more fully described by way of example with reference to the following drawings. In the following drawings, FIG. 1 illustration of part of a profile element panel according to the invention with a plurality of passage-forming spacer elements therein, FIG. 5 illustrates a modified embodiment of the cavity floor construction shown in FIG. 4.

DETAILED DESCRIPTION OF THE DRAWINGS

Figure 1:
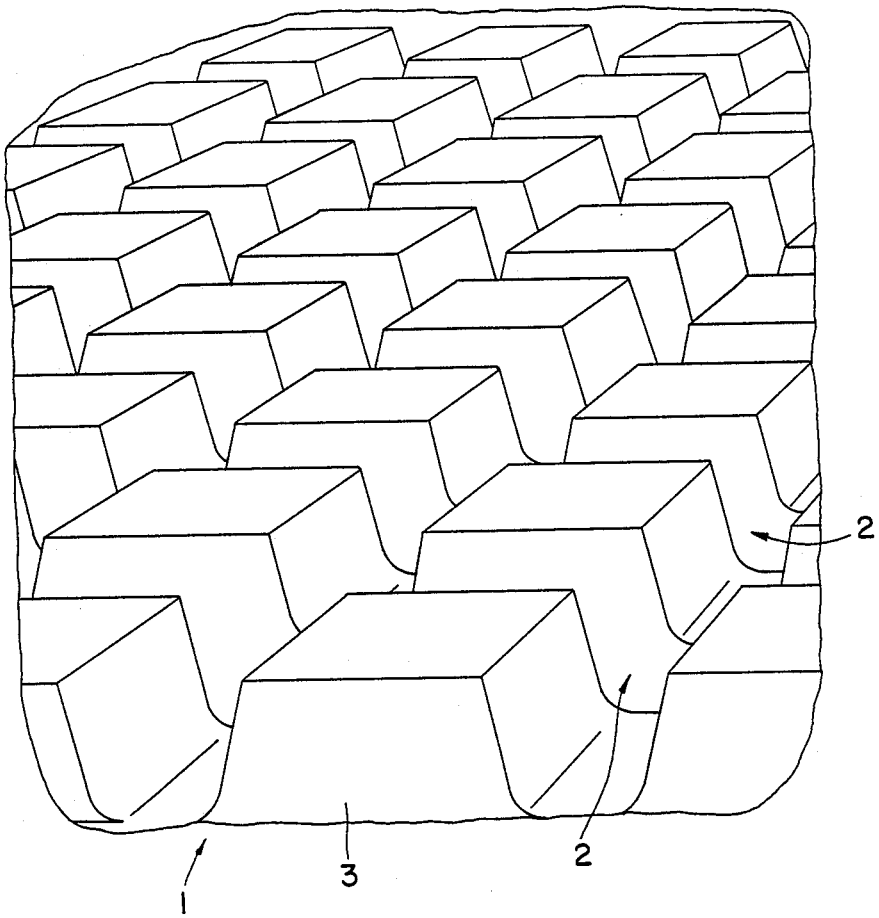

FIG. 1 illustrates a profile element panel 1 having a plurality of spacer elements 3 forming passages or channels 2 in accordance with this invention. The spacer elements 3, which are arranged uniformly on the profile element panel 1, are constructed as upwardly tapering truncated pyramidal structures. Accordingly, the cross-section area of the passages 2 increases in an upward direction. The ratio of the height of the spacer elements 3 to that of the base height of the profile element panel 1 is about 3:1.

Figure 2:
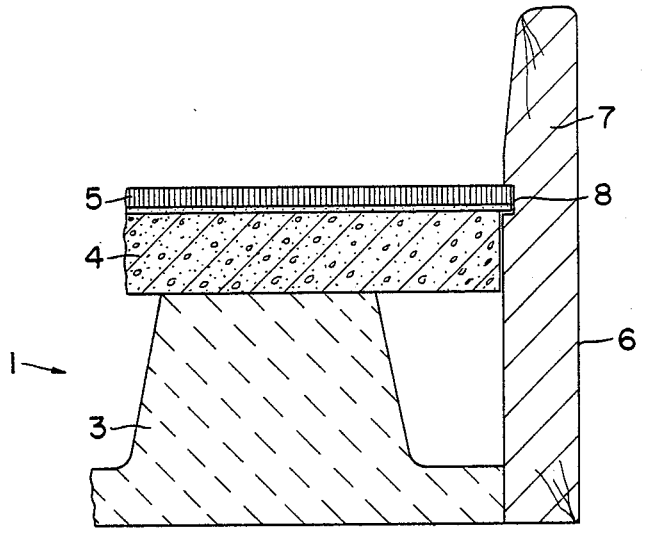
FIG. 2 is a sectional illustration of a rim element having a straight surface at a wall face.

The complete structure of a two-layer cavity floor covering is shown in FIG. 2. A surface or cover layer 4 with a floor covering 5 is laid on the spacer element 3. The edging along a wall surface 6 is formed by a straight-faced boundary element 7 with a groove 8 which is used to accommodate the boundary edge of the floor covering 5.

Figure 3:
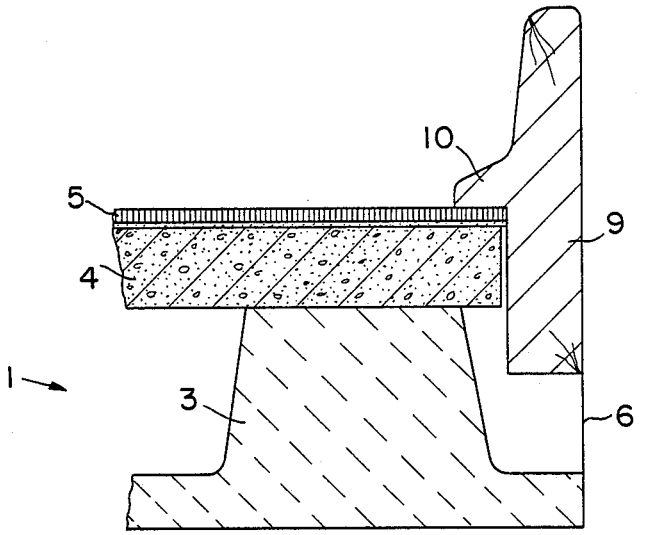
FIG. 3 is a sectional illustration as in FIG. 2 depicting a rim element having a bearing shoulder which rests on the cover layer of the cavity floor covering, FIG. 4. is a sectional illustration of another embodiment of a cavity floor construction in accordance with this invention.

An alternative form of edging of the cavity floor construction is shown in FIG. 3. In this case, the edging is formed by a boundary element 9 with a contact or bearing shoulder 10.

The cavity floor construction according to the invention is installed in the following manner. After cutting to size, the individual profile element panels 1 are laid on a floor surface (not shown) in an existing building or new building. All supply lines (not shown in the drawing) may be laid in any desired direction in the plurality of passages 2 of the profile element panels 1. After the supply lines have been installed, the surface layer 4 correspondingly cut to size is laid on the spacer elements 3 of the profile element panels 1. If desired, the surface layer 4 may be bonded or glued to the profile element panels 1.

The illustrated floor covering may have the following exemplary dimensions. The height of the profile element panel 1 may be about 15 millimeters, that of the spacer elements 3 may be about 45 millimeters, and that of the surface layer 4 may be about 22 millimeters. Altogether, an overall height of only about 85 millimeters thus results, subject to consideration of the floor covering 5. Thus, this floor covering structure is suitable particularly for use in the refurbishing field.

The straight-faced boundary element shown in FIG. 2 represents one possible form of edging. The boundary element 7 may be fixed to the wall surface 6 before the actual floor construction is installed. The bottom edge of the boundary element 7 rests on the surface of the floor. The groove 8 in he boundary element 7 accommodates the edge of the floor covering 5 on the surface layer 4.

Alternatively, it is possible to use the boundary element 9 shown in FIG. 3 with the contact or bearing shoulder 10 which is fitted after installation of the cavity floor construction. It rests through the shoulder 10 on the floor covering 5 and hence on the surface layer 4. The shoulder 10 also serves as a finishing edge or skirting board. The lower end of the boundary element 9 remains at a distance from the floor or from the bottom of the profile element panel 1.

The profile element panel 1 and also the boundary elements 7 and 9 consist of a noise-insulating material preferably based on polyurethane bound in a polyurethane foam. The noise-insulating material may consist of polyurethane and mineral aggregate or expanded clay, of polyurethane and rubber or even of polyurethane and an inorganic recycled material or a porous material. These materials of the two-layer cavity floor construction lead to extremely high noise and footstep insulation without any need for additional base layers, providing for a minimal overall height. The surface layer 4 advantageously consists of sawdust, cement and an acrylate dispersion.

Another embodiment of the invention is shown in FIGS. 4 and 5. Compared with the embodiment shown in FIGS. 1 to 3, the profile element panel 11 are oppositely arranged, i.e. with the spacer elements 12 lying face down on a subfloor 13. A sheet or film 15 of plastic or the like is placed on the surface 14 of the profile element panels 11 and is covered by a surface layer 16. The surface layer 16 is preferably formed by a quick-drying screed applied after laying of the profile element panels 11 and the film 14 which is used for sealing. Any uneven areas in the subfloor 13 can be levelled off by this layer of screed. This embodiment of the floor construction is also distinguished by particularly good noise and footstep insulation, the profile element panels 11 again being formed from the noise-insulating materials mentioned above, in addition to which the screed may contain corresponding noise-insulating additives.

FIG. 4 show one possible embodiment of a joint at the junction between two profile element panels 11. The profile element panels 11 have not been specially finished, but abut one another with free shoulders 17. To ensure the stability of the floor construction in this region, a reinforcement 18 is provided in the plastic screed 16.

As shown in FIG. 5, there is no need for this reinforcement providing the profile element panels 11 are cut off at their edges in such a way that the spacer elements 12 abut one another at their adjoining edges.

The invention is of course not confined to the embodiments shown by way of example in the accompanying drawings. Other embodiments are possible without departing from the basic concept of the invention. Thus, it is also possible to use profile element panels of other noise-insulating materials. However, the essential feature is that no additional noise-insulating layers are necessary, guaranteeing the minimal overall height of the floor construction.

We claim:

1. A two-layer cavity floor covering structure comprising a base layer, a cover layer adjacently overlaying said base layer, and a rim binding providing the edging along a wall surface to accommodate the boundary edge of said cover layer, said base layer comprising a profile element panel having a plurality of spacer elements forming channels in said panel, said spacer elements being constructed as upwardly tapering truncated pyramidal structures, and said base layer being formed from a noise-insulating material containing polyurethane bound in a polyurethane foam.

2. A cavity floor covering structure as in claim 1 wherein said noise-insulating material is selected from polyurethane and mineral aggregate or expanded clay bound in said polyurethane foam.

3. A cavity floor covering structure as in claim 1 wherein said noise-insulating material is selected from polyurethane and rubber bound in said polyurethane foam.

4. A cavity floor covering structure as in claim 1 wherein said cover layer comprises sawdust, cement or an acrylate dispersion.

5. A cavity floor covering structure as in claim 1 wherein said rim binding comprises a rim element having a straight face adapted for attachment to a wall surface, and whose lower edge rests on a floor surface.

6. A cavity floor covering structure as in claim 1 wherein said rim binding comprises a rim element having a bearing shoulder for support at the upper edge of said cover layer, and whose lower edge provides a spacing from a floor surface.

7. A cavity floor covering structure as in claim 1 wherein the ratio of the height of said spacer elements to that of the base height of said profile element panel is about 3:1.

8. A cavity floor covering structure as in claim 1 wherein said rim binding is provided with a groove therein to receive the edge of said cover layer.

9. A cavity floor covering structure as in claim 1 wherein said noise-insulating material is selected from polyurethane and an organic recycled material or a porous material bound in said polyurethane foam.

10. A cavity floor structure as in claim 9 wherein said porous material comprises expanded clay.

11. A cavity floor covering structure as in claim 1 wherein said spacer elements face a sub-floor surface, and said cover layer comprises a fast-drying screed.

12. A cavity floor covering structure as in claim 11 wherein said fast-drying screed contains alumina cement, gypsum and organic additives, and aggregates.

13. A two-layer cavity floor covering structure comprising a base layer, a cover layer adjacently overlaying said base layer, and a rim binding providing the edging along a wall surface to accommodate the boundary edge of said cover layer, said base layer comprising a profile element panel having a plurality of spacer elements forming channels in said panel, said spacer elements being constructed as upwardly tapering truncated pyramidal structures, said base layer being formed from a noise-insulating material containing polyurethane bound in a polyurethane foam, and said cover layer comprising sawdust, cement or an acrylate dispersion.

14. A cavity floor covering structure as in claim 13 wherein said noise-insulating material is selected from polyurethane and mineral aggravate or expanded clay bound in said polyurethane foam.

15. A cavity floor covering structure as in claim 13 wherein said noise-insulating material is selected from polyurethane and rubber bound in said polyurethane foam.

16. A cavity floor covering structure as in claim 13 wherein said rim binding comprises a rim element having a straight face adapted for attachment to a wall surface, and whose lower edge rests on a floor surface; or a rim element having a bearing shoulder for support at the upper edge of said cover layer, and whose lower edge provides a spacing from a floor surface.

17. A cavity floor covering structure as in claim 13 wherein said noise-insulating material is selected from polyurethane and an organic recycled material or a porous material bound in said polyurethane foam.

18. A cavity floor structure as in claim 17 wherein said porous material comprises expanded clay.

19. A cavity floor covering structure as in claim 13 wherein said spacer elements face a sub-floor surface, and said cover layer comprises a fast drying screed.

20. A cavity floor covering structure as in claim 19 wherein said fast-drying screed contains alumina cement, gypsum and organic additives, and aggregates.

* * * * *